United States Patent [19]

Shnitkin et al.

[11] 4,348,679

[45] Sep. 7, 1982

[54] MULTI-MODE DUAL-FEED ARRAY RADAR ANTENNA

[75] Inventors: Harold Shnitkin, Roslyn, N.Y.; Peter W. Smith, Westport, Conn.

[73] Assignee: United Technologies Corporation, Hartford, Conn.

[21] Appl. No.: 194,155

[22] Filed: Oct. 6, 1980

[51] Int. Cl.[3] ..... H01Q 13/10; H01Q 3/30

[52] U.S. Cl. ..... 343/768; 343/854

[58] Field of Search ..... 343/854, 768, 771, 853

[56] References Cited

U.S. PATENT DOCUMENTS

| | | | |
|---|---|---|---|
| 2,925,595 | 2/1960 | Thourel | 343/16 |
| 3,222,677 | 12/1965 | Fink | 343/854 |
| 3,308,468 | 3/1967 | Hannan | 343/777 |
| 3,325,816 | 6/1967 | Dutton | 343/777 |
| 3,392,395 | 7/1968 | Hannan | 343/755 |
| 3,460,144 | 8/1969 | Hannan | 343/777 |
| 3,509,577 | 4/1970 | Kinsey | 343/854 |
| 3,940,770 | 2/1976 | Fassett et al. | 343/854 |
| 3,990,077 | 11/1976 | Beaulieu et al. | 343/854 |

OTHER PUBLICATIONS

Lopez, Monopulse Networks for Series Feeding an Array Antenna, IEEE Transactions, vol. AP-16, No. 4, Jul. 1968.

*Primary Examiner*—Eli Lieberman

*Attorney, Agent, or Firm*—Richard P. Lange

[57] ABSTRACT

A multi-aperture array antenna provides a narrow beam width, low side lobe radiation pattern for an illuminating beam through the forward feed of a ladder-type feed structure. Alternatively, the rear feed of the ladder network is so electrically tapered as to provide three simultaneous low side lobe smaller apertures which can be independently directed via phase shifters to provide distinct received beams for interferometric phase comparison. A feed connected to one radiating element in each of the three apertures form a broad-beam pattern for side-lobe cancellation. A phase shifter is positioned adjacent to each radiation element to steer the beam and switch between antenna functions by precise control of the phase excitation to each port. The feed structure is connected in a ladder configuration forming a front feed and a rear feed. The front feed network is connected through one feed structure to the transmitter such that all the radiating elements can be used to generate a single high gain, narrow illuminating beam aperture for searching and mapping. The rear network is connected through three distinct feed structures to a separate receiver, such that each receiver uses one-third of the radiating elements forming separate lower gain, wider beam apertures for azimuth direction finding by interferometric measurements. The three separate apertures formed through the rear feed network can also be independently directed through proper control signals applied to the phase shifters.

10 Claims, 6 Drawing Figures

FIG. 2
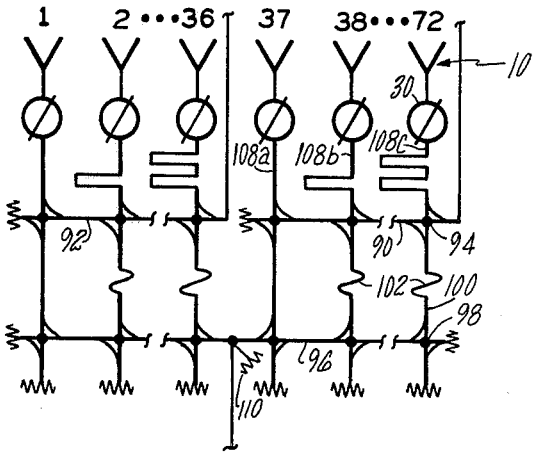
FIG. 3 FRONT-FEED AMPLITUDE TAPER
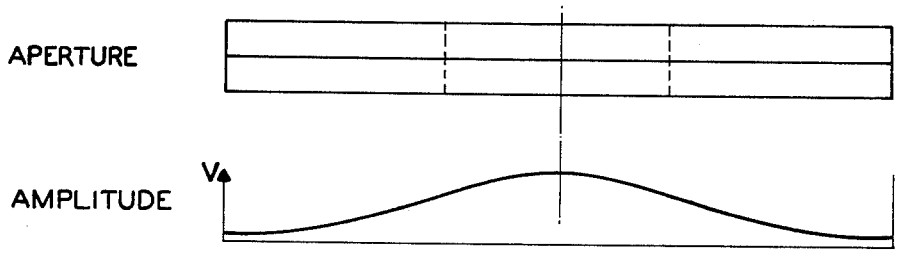
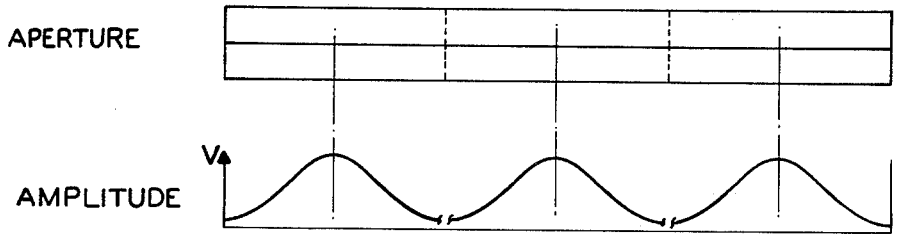
FIG. 4 REAR-FEED AMPLITUDE TAPER

MULTI-MODE DUAL-FEED ARRAY RADAR ANTENNA

The Government has rights in this invention pursuant to Contract No. F30602-78-C-026, awarded by the Department of the Air Force.

DESCRIPTION

1. Technical Field

This invention relates to an array antenna, and, more particularly, to a dual-feed array antenna capable of multiple modes by switching of the radiating elements between a front and a rear feed, or by switching between a full aperture or smaller apertures.

2. Background Art

Array antennas are generally known and have been used for many years, particularly in the radar field, to transmit an illuminating beam of electromagnetic energy toward a distant object and then receive the reflected signal. An array antenna typically includes a plurality of radiating elements which are fixedly mounted in locations that are equally spaced from each other, both laterally and vertically. By phase adjusting the signal waveform presented to each of the radiating elements, the beam is scanned in azimuth and elevation. Each individual radiating element is connected through an individual phase shifter which must be independently set to control its phase delay. The control signals presented to a phase shifter are typically calculated by a processing system which includes known algorithms for establishing the proper radiated phase front perpendicular to the given beam direction. The radiating elements are fed through a complex RF distribution assembly which often includes directional couplers that are physically connected into the feed path.

Array antennas are also well suited for use in monopulse tracking. The radiating elements of the array can be combined in different ways to give the sum patterns and difference patterns in both azimuth and elevation. As is known, the independent control of both amplitude and phase at the aperture when energized from several independent RF input terminals is necessary for the generation of multiple simultaneous beams.

The most commonly used radiators for phased arrays are dipoles, slots, open-ended waveguides and spirals. The type of radiator selected depends, in part, on the desired elevation beamshape and gain. Another significant requirement is that the radiator be small enough to fit in the array geometry thereby limiting the element to an area of approximately a little more than ($\lambda^2/4$). In addition, because many radiators are required, the radiating element should be inexpensive, reliable, and repeatable from unit to unit. Since the impedance and radiation pattern of a radiator in an array are strongly influenced by the array environment, the radiating element may be chosen to suit the feed system and the physical requirements of the antenna. The beam of an antenna points in a direction that is normal to the constant phase front. In a phased array, this phase front is adjusted to steer the beam by individually controlling the phase excitation of each radiating element. To accomplish this, the phase shifters are electronically actuated to permit rapid scanning and must be adjusted in phase to a value of between zero and $2\pi$ radians.

Of interest is an article appearing in the IEEE Transactions on Antennas and Propagation, Vol. AP-16, No. 4, July 1968, entitled "Monopulse Networks for Series Feeding an Array Antenna" by Alfred R. Lopez, which describes a number of series networks for feeding an array antenna, some of which are ladder networks. FIG. 3 shows a "center-fed" ladder network for series feeding a monopulse array antenna. This network consists of two end-fed ladder networkds fed at the center by two hybrid junctions and an additional directional coupler. The sum mode excitation is provided by setting the primary-line couplers and feeding an input to the primary line. The feed structure in this disclosure is designed primarily for a monopulse technique such that a sum and difference port is provided. The array antenna disclosed in this article is not capable of providing multiple mode operation in the same manner as the present invention.

It is also known that a ladder feed network in which the series feeds have a different phase taper can be used to generate distinct apertures for the plurality of radiating elements in an array. For example, see R. C. Hansen (Ed.), "Microwave Scanning Antennas," Vol. 3, pages 247–256. The Blass array is illustrated in FIG. A1. This reference teaches that the spurious lobe level L due to the interaction between two feeds having uniform illumination and beam separations of B beamwidth is $L=-20 \log (4\pi B)$.

DISCLOSURE OF INVENTION

It is an object of the present invention to provide an array antenna having the capability of using all of the radiating elements as either a single full aperture or three identical smaller apertures whose phase centers are separated in azimuth.

A particular feature of the present invention is an array antenna with a particular feed network allowing all of the radiating elements to function as a single large aperture, or, alternatively, to operate as several independently directable multiple apertures for interferometric measurements or for multiple target tracking. A ladder feed network includes a forward feed and a rear feed, each of which forms a distinct radiation pattern that is tapered for a particular radar mode.

According to yet another aspect of the present invention, an array antenna having a given number of array elements is capable of using all of the array elements as radiators while operating in a number of distinct radar modes, such as search and map mode, interferometric mode, triple track mode and side lobe cancellation mode. In the search and map mode, all of the array elements act as a single large aperture which generates a narrow beam for illuminating and receiving with low side lobes and can be scanned by the phase shifters to search for one or more targets, or to map terrain, or both. For the interferometric mode, the rear feed of the ladder feed network is electrically tapered to form three identical low side lobe apertures having a wider beam width but which can be pointed in the same azimuth direction for identifying phase of arrival of the reflected radar pulses so that precise angle calculations can be performed. In the triple track mode, the rear feed of the ladder network is used and the three apertures can then be directed independently, as needed, to track separate targets, map different quadrants or combinations thereof. In side lobe cancellation, a feed attached to a single radiating element of each of the apertures forms a single very wide beam for each of the apertures and can be used for side lobe cancellation by phase coincidence.

According to the present invention, a multiaperture array antenna is particularly well suited for providing a narrow beam width, low side lobe radiation pattern for an illuminating beam through the forward feed of a ladder-type feed structure. Alternatively, the rear feed of the ladder network is so electrically tapered as to provide three simultaneous low side lobe smaller apertures which can be independently directed via phase shifters to provide distinct received beams for interferometric phase comparison. A feed connected to one radiating element in each of the three apertures forms a broad-beam pattern for side lobe cancellation. The array antenna, in preferred form, comprises 432 radiating elements arranged in two rows, one above the other, each with 216 radiating elements. A phase shifter is positioned adjacent to each radiating element to steer the beam and switch between antenna function by precise control of the phase excitation to each port. The feed structure is connected in a ladder configuration forming a front feed and a rear feed. The front feed network is connected through one feed structure to the transmitter such that all the radiating elements can be used to generate a single high gain, narrow illuminating beam aperture for searching and mapping. The rear network is connected through three distinct feed structues to a separate receiver, such that each receiver uses one-third of the radiating elements forming separate lower gain, wider beam apertures for azimuth direction finding by interferometric measurements. Of course, the three separate apertures formed through the rear feed network can also be independently directed through proper control signals applied to the phase shifters.

The foregoing and other objects, features and advantages of the present invention will become more apparent from the following description of preferred embodiments and accompanying drawings.

BRIEF DESCRIPTION OF DRAWINGS

FIG. 2 is a schematic representation of a portion of the array antenna showing details of the ladder feed network;

FIG. 3 is a diagram showing the aperture formed by the front feed of the array antenna together with its amplitude illumination taper;

FIG. 4 is a diagram showing the three apertures formed by the rear feed together with their aperture tapers;

BEST MODE FOR CARRYING OUT THE INVENTION

Figure 1:
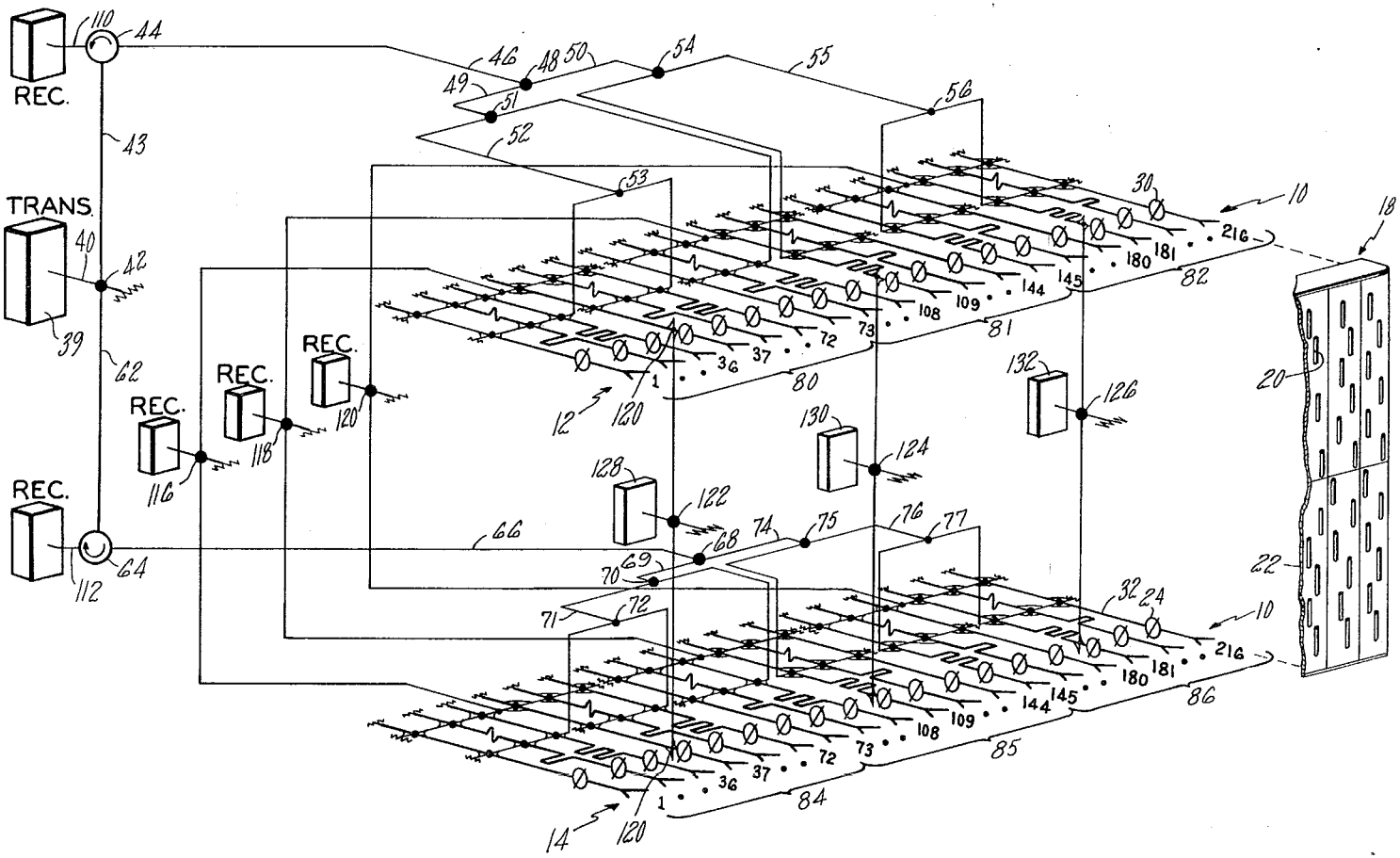
FIG. 1 is a diagram, partially in schematic form and partially in perspective form, depicting an array antenna and its feed network according to the present invention.

Referring initially to FIG. 1, there is seen a partial schematic illustration of one embodiment of the array antenna according to the present invention. The antenna comprises a plurality of radiating elements 10 positioned in two laterally extending rows, row 12 and row 14. In the present configuration, each radiating element 10 of the row 12 is formed by a resonant vertical waveguide array containing six slots 20 which are vertically displaced from each other in the top half of an aperture plate 18. An identical series of slots 22, also preferably six in number, are located in the lower half of the aperture plate 18 and form the row 14 of radiating elements 10. While other types of radiating elements are known, such as open-ended waveguides, small horns, dipole, etc., the slotted aperture plate is particularly desirable since the radiating elements can be positioned relatively close ($\lambda_o/2$) to each other to avoid extraneous radiation lobes.

Although the antenna can be mechanically oriented by its mounting to face in any desired direction, for the purposes of the following explanation, the azimuth direction $\phi_A$ will be considered to be the lateral direction, i.e., the same direction as the rows 12 and 14 while the elevation angle $\theta_E$ will be vertical as shown in FIG. 1.

As mentioned, the array antenna of the present invention includes a plurality of radiating elements 10, arranged in rows, and each row in preferred form has 216 therein. However, it should be understood that the array antenna could include a greater or lesser number of radiating elements in each row, or alternatively could even include more than two rows. In any event, the trade-offs relating to more or less radiating elements, either laterally or vertically, are well known to those of ordinary skill.

A particular feature of the present invention relates to the novel feed configuration which allows the antenna to function either as a single large transmitting aperture for the illuminating beam which can be rapidly electronically scanned in azimuth or elevation, of alternatively as three identical receive apertures which can be focused along a single azimuth and elevation orientation so that interferometric phase front measurements can be performed. The receive apertures can also be completely independently focused in different azimuth angles $\phi_A$ and elevation directions $\theta_E$ so that separate targets can be tracked.

Referring still to FIG. 1, the novel feed network of the present invention will now be described. A phase shifter 30 is connected to each radiating element 10 for scanning the array. A particular feature of the array antenna according to the present invention is the novelty configuration that allows an illuminating beam to be collimated by this single full aperture comprised of all the radiating elements 10, or alternatively, the same array elements 10 can function as three smaller apertures, each of which are independently controlled by the phase shifters so that the antenna can operate in a number of different modes, e.g., search and mapping mode, interferometric mode, triple target track mode or side lobe cancellation mode. First, considering the illuminating aperture, high frequency electrical energy is generated by a transmitter 39 and propagates through a waveguide 40 to a power divider 42, such as a magic T, which divides the illuminating power equally between the upper and lower halves of the antenna. The illuminating power to the upper half of the antenna then propagates along a waveguide 43 to a circulator 44 which couples the illuminating power on to a waveguide 46 and another power divider 48, also preferably a magic T. The power divider 48 is symmetrically loaded by the waveguides 49 and 50 such that the transmitted power is equally divided between the radiating elements 10 comprising the left half of row 12 and the right half of row 12. A power divider 51, such as a directional coupler, is positioned at the outward end of the waveguide 49 and, together with a power divider 53 located at the outward end of the waveguide 52 and the power divider described hereinafter, divide the illuminating power on this left half of the row 12 such that the power tapered smoothly decreases from the center to the edge of the antenna (see FIG. 3). In a similar manner, the feed structure for the right portion of the antenna includes a power divider 54, such as a directional coupler, which is coupled to the outward end of the waveguide 50. A power divider 56 at the outward end of a waveguide 55, together with the power divider 54, divide the incoming RF energy such that the illuminating beam is symmetrically tapered from the center of the antenna to the edge (see FIG. 3).

The feed structure to the lower half of the antenna is similar and includes a waveguide 62 which leads from the power divider 42 to a circulator 64. RF energy from the transmitter is coupled on by the circulator 64 to a waveguide 66 and a power divider 68 which divides the RF energy equally between the two halves of this lower portion of the antenna. To supply the left portion of the antenna, a waveguide 69 leads to a power divider 70, and, via a waveguide 71, to a power divider 72, both of which are directional couplers. The two power dividers 70 and 72, in addition to the power dividers described hereinafter, are selected to provide an amplitude taper to this portion of the antenna. In a similar manner, a waveguide 74 leads from the power divider 68 to a power divider 75, and, via a waveguide 76, to a power divider 77.

One aspect of the array antenna according to the present invention is its multi-mode operation that allows the plurality of radiating elements 10 to act as; a single large transmit aperture for the illuminating beam, three smaller independently directable receive apertures, a single large receive or transmit aperture. This is, in part, the result of the novel dual ladder feed configuration for the array elements which allows independent excitation via a front and rear feed as well as connection to three individual radiating elements. Still referring to FIG. 1, it will be noted that the feed structure is configured such that the radiating elements 10 of each row are grouped into three distinct subgroups, i.e., row 12 includes subgroup 80, subgroup 81, and subgroup 82, together which form the upper half of the antenna. Similarly, subgroup 84, 85 and 86 are formed from the radiating elements in the row 14 and form the lower half of the antenna. In preferred form each of these subgroups includes one-third of the radiating elements of each row so that the independently controlled apertures are of equivalent size.

It will also be observed that the ladder feed network of the present invention is arranged such that within each subgroup, the radiating elements 10 can be fed from either the forward feed or the rear feed. Referring now to FIG. 2, there is seen a drawing depicting one of the subgroups of array elements shown in perspective form in FIG. 1. It will be noted that the ladder feed network includes a front feed 90 and a front feed 92 which, via a series of directional couplers 94 at each forward junction, "end feeds" each subgroup of radiating elements 10 attached thereto. The ladder network also includes a rear feed 96 which "center-feeds" each subgroup of the radiating elements 10 through series couplers 98, one of which is positioned at each rear junction of the ladder network. Extending between each of the series couplers 98 of the rear feed 96 and the series couplers 94 of the front feed is either a zero phase line 100, or alternatively a $\pi$ phase line 102. In other words, every other waveguide between the series couplers connecting the front and rear series couplers is of the same phase while adjacent waveguides are out of phase by $\pi$ radians. This causes the front feed 92 and rear feed 94 to be loaded orthogonally for the purpose of electrical isolation between the two feeds and of minimizing the amount of energy lost (dissipated) to the front feeds 90 and 92 when the rear feed is used for reception. As will be appreciated, in the calculation of the setting for each phase shifter 30, consideration must be given to the phase shift introduced by the $\pi$ phase line 102 which alternates with the zero phase shift lines. It should also be noticed that the waveguide extending from each series coupler 94 for the front feed of the ladder to each phase shifter is connected by a waveguide which is of a predetermined length such that the resultant signal is properly phase compensated. For example, in FIG. 2 waveguide **108*a* is shorter than waveguide 108*b*, which is in turn shorter than waveguide 108*c*, but the overall group delay from the first series coupler 94 of the front feed to each of the radiation elements 10** is exactly the same.

As briefly mentioned herebefore, a particular aspect of the array antenna according to the present invention is concerned with its multi-mode performance, one of which is a side lobe cancellation mode. As is known, for side lobe cancellation an antenna must have a very wide beam in azimuth $\phi_A$ so that gain exceeds the side lobe level of both search and interferometer antennas but is considerably less than their main beams. In addition, the side lobe cancellation antenna should have a beam whose elevation radiation pattern is similar to that of the antenna whose side lobe is to be canceled. Finally, it is important for side lobe cancellation that the wider beam and narrow beam have coincident phase centers so that there will be no phase distortion. The present invention solves these problems by using a single element near the center of each of the three apertures to form the single wide azimuth receive beam. Referring again to FIG. 1, the array antenna includes a directional coupler 120 situated in one of the waveguides to the radiating elements 10 of each aperture. In other words, one array element of each upper and lower subgroups includes a directional coupler 120 between one of the radiating element 10 and its phase shifter 30. It is important that the array element 10 be located near the center of the aperture; thus, in the present invention, this corresponds to array element 37, 109, and 181 in both the upper row 12 and the lower row 14. A waveguide leads from each directional coupler to a combiner 122, 124, and 126 which combines the received energy associated with each of the three beams. Accordingly, the elevation beam shape and the phase centers are closely matched to permit side lobe cancellation of the apertures comprised of one-third of the radiating elements. A separate receiver 128, 130 and 132 is provided, and each is connected to the power combiner 122, 124, and 126, respectively.

Although not part of the present invention other than as heretofore described, a phase shifter 30 should be selected to match the performance requirements of a radar system, such as the output power of the transmitter and phase shifter reset time. For example, one particular phase shifter which is particularly well suited to operating in the present invention is a nonreciprocal type known as the toroidal latching ferrite phase shifter. However, it should be understood that numerous different types of phase shifters, either reciprocal or nonreciprocal, could be used in the present invention. It will be appreciated that the performance factors versus cost trade-off with respect to the important parameters of a phase shifter are well known to those of ordinary skill. For example, in general the insertion loss of each phase shifter should be as low as possible because it results in a loss of power to the illuminating beam, and also a lower signal-to-noise ratio for the receive beam. The time required to switch each phase shifter from one setting to another should be as short as possible to reduce the minimum radar range and to decrease the overall time required to transmit a number of pulses in different directions. Of course, the phase error should be as small as possible for maximum antenna gain and minimum side lobes. However, because the phase calculation is normally done by a digital circuit, the phase error is also a function of the least significant bit of the digital phase calculation. Both the physical size and weight of each phase shifter is also important, particularly in the present invention which is well suited to airborne applications, because there is a phase shifter for each radiating element and it is preferably located next to the aperture plate 18 to reduce the length of waveguide between the phase shifter and the radiating element 10.

In operation, it will be understood by those of ordinary skill that the array antenna of the present invention is typically used as one component in a radar system which would most likely include some sort of processing system to manipulate the received radar data. A particular application for which the array antenna of the present invention is well suited is AMTI (airborne moving target indication) radar system, which because of its compact size and multiple uses is especially desirable on a moving platform, such as an aircraft or the like. An AMTI radar rejects signals from unwanted fixed targets, such as buildings, hills, and trees, while retaining or detecting signals from moving targets such as aircraft or ground vehicles. The rejection of returns from these fixed targets, known as clutter, involve the processing of the returned signals which are reflected from the targets. Extraction of this data is a complex process involving numerous arithmetic calculations to be performed at high speeds by a large computer, all of which is beyond the scope of this discussion. However, it will be appreciated that the array antenna of the present invention forms the aperture through which the illuminating pulse of electromagnetic energy from an RF generator is transmitted. This same array antenna has the phase shifters 30 reset to form the receive aperture through which the reflected electromagnetic energy is received. As such, the performance characteristics of the array antenna are significant in defining the operational characteristics of the entire radar system.

Figure 5:
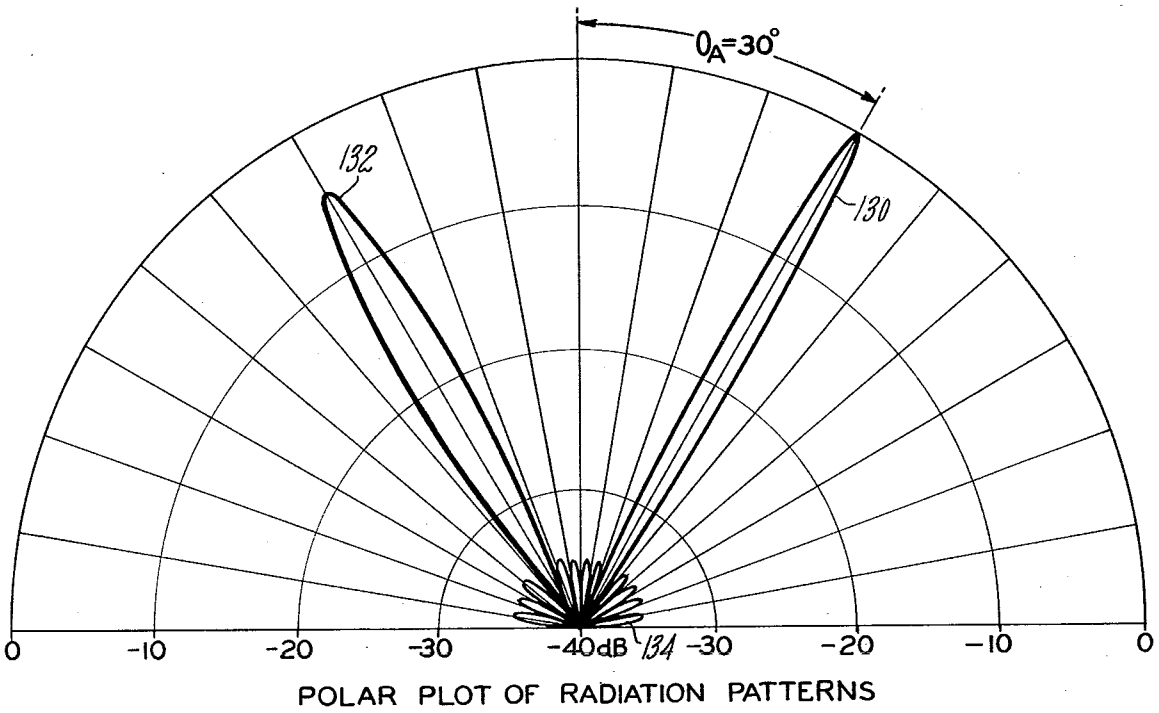
FIG. 5 is a polar plot depicting the radiation patterns of the array antenna in which the beam of the full aperture has been scanned by the phase shifters to $\phi_A=30°$.

Referring now to FIG. 5, there is seen a polar plot depicting a radiation pattern of an array antenna according to the present invention. In the pattern depicted in FIG. 5, the beam 130 corresponds to that at the front feed of the array antenna according to the present invention. As is seen, this beam has been scanned by appropriate control signals applied to the phase shifters 30 to collimate the beam along an axis of $\phi_A=30°$. At this particular phase shifter setting, there is also a beam 132 associated with the rear feed structure directed to $-30°$. This angular separation of 60° is as close as the two beams come at any setting of the phase shifters 30. Resetting the phase shifter beam along an axis of $\phi_A=30°$ for the rear feed structure will cause beams 130 and 132 to exchange places. As will be appreciated, there are also a number of side lobes 134 which are of significantly lower amplitude than either of the two main beams.

Figure 6:
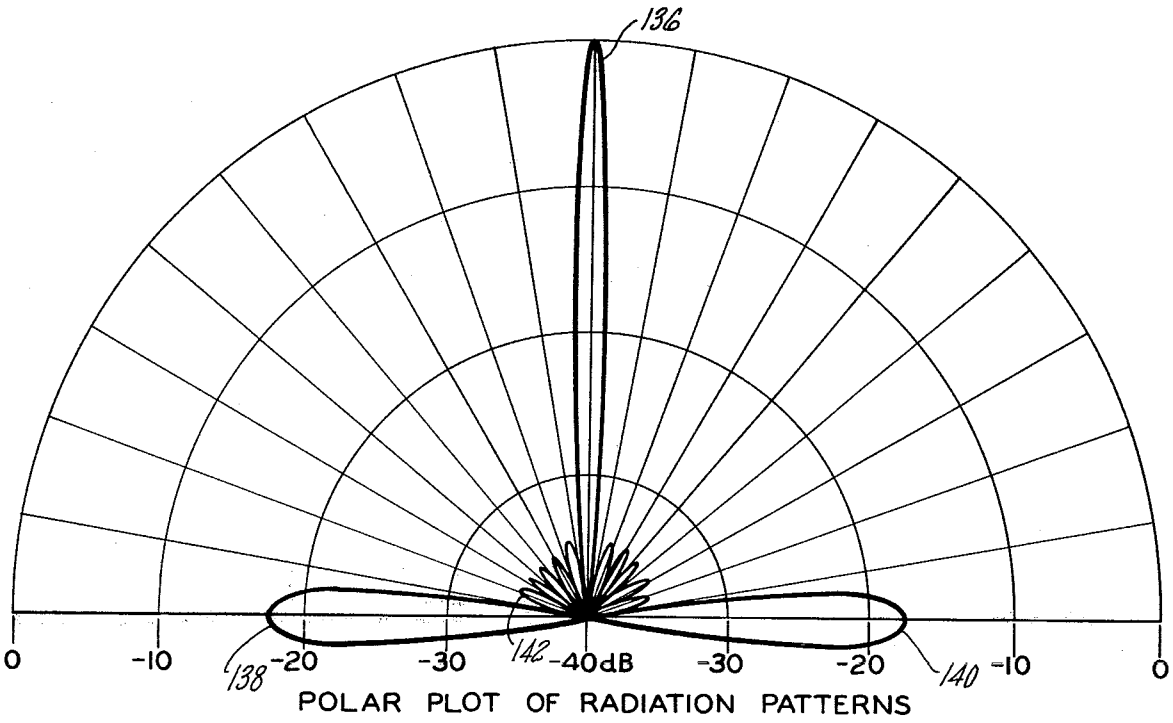
FIG. 6 is a polar plot depicting the radiation patterns of the array antenna in which the beam of the full aperture is at boresight, $\phi_A=0°$.

Referring now to FIG. 6, there is seen a polar plot depicting the two beams at another setting of the phase shifters 30. The beam 136 is that of the front feed and is on boresight, or $\phi_A=0$. It will be noted that there are two attenuated beams associated with the rear feed, the beam 138 and beam 140, and that these two beams are on end fire. As before, a number of side lobes 142 are present and are of a much lower intensity than the main beams.

Although this invention has been shown and described with respect to a preferred embodiment, it will be understood by those skilled in this art that various changes in form and detail thereof may be made without departing from the spirit and scope of the claimed invention.

We claim:

1. An array antenna capable of sequentially operating in either a transmit mode and one of several receive mode, comprising:

means including a plurality of array elements disposed in a planar configuration, said array elements being positioned in at least one laterally extending row, adjacent ones of said array elements being separated by a distance corresponding to about one-half of the wavelength ($\lambda_0/2$), of said radar signals;

phase shifting means connected to each one of said plurality of array elements for directing the beam of said antenna in said transmit mode and also for selecting one of said several receive modes and then for directing the receive beam in such receive mode, each of said phase shifting means being individually controllable to vary the phase of radar signals propagating therethrough in response to a control signal for collimating either of said transmit aperture or said receive aperture in a preselected direction;

an array feed means connected to each of said plurality of array elements through said phase shifting means, said feed means being in a ladder configuration and having a front feed and a rear feed which are interconnected by transmission lines; and antenna feed means connected to said array feed means for providing a propagation path for said radar signals to, and from, said plurality of array elements.

2. An array antenna according to claim 1, wherein said plurality of array elements are arranged in two rows, each row having an equal number of array elements.

3. An array antenna according to claim 1, wherein said front feed of said ladder arrangement is connected for series feeding the array elements by means of series couplers, and wherein said series couplers are located at the junction of the ladder elements and are loaded to couple off therefrom in a sequential manner.

4. An array antenna according to claim 3, wherein said front feed of said ladder network is connected to said antenna feed means at the end thereof, thus providing a symmetrical amplitude taper over the whole aperture formed by said plurality of array elements.

5. An array antenna according to claim 1, wherein alternate ones of said waveguides connecting said front feed and said rear feed are sized to be a $\pi$ phase shift line to form orthogonal beams thereby minimizing interaction between said front feed and said rear feed.

6. An array antenna according to claim 1, wherein said array elements are grouped in three separate subgroups, and wherein said rear feed of said array feed means of each subgroup is connected to a center feed, said corresponding array elements thus providing a symmetrical amplitude taper to each subgroup so that each one of said subgroups can operate as an independently controllable aperture having low side lobe characteristics.

7. An array antenna according to claim 6, further including a receiver connected to said feed means of each of said subgroups so that said array antenna can perform interferometric measurement of phase fronts.

8. An array antenna according to claim 1, wherein said array antenna is a part of a multi-mode radar system in which said plurality of array elements are fed via said front feed to transmit aperture, and wherein said antenna feed means and said array feed means phase taper radar energy to form an illuminating beam.

9. An array antenna according to claim 8, wherein said rear feed of said ladder configuration forms three separate receive apertures, each of which is independently directable by suitable control signals applied to said phase shifting means.

10. An array antenna according to claim 9, wherein said independently directable receive apertures are used for interferrometric measurement of the phase centers of reflected radar pulse.

* * * * *

UNITED STATES PATENT AND TRADEMARK OFFICE

CERTIFICATE OF CORRECTION

PATENT NO. : 4,348,679

DATED : September 7, 1982

INVENTOR(S) : HAROLD SHNITKIN and PETER W. SMITH

It is certified that error appears in the above-identified patent and that said Letters Patent is hereby corrected as shown below:

In the Abstract, line 12, "radiation" should be -- radiating --

Column 2, line 6, "networkds" should be -- networks --

Column 3, lines 23 and 24, "structues" should be -- structures --

Column 4, line 29, "of" should be -- or --

Column 10, line 13, "interferrometric" should be -- interferometric --

Signed and Sealed this

*Twenty-third* Day of *November 1982*

[SEAL]

*Attest:*

GERALD J. MOSSINGHOFF

*Attesting Officer*

*Commissioner of Patents and Trademarks*